United States Patent [19]

Takagi

[11] 4,433,203

[45] Feb. 21, 1984

[54] ELECTRICAL INSULATOR WITH WATER-REPELLENT OIL-BLEEDING INSULATION BANDS

[75] Inventor: Kunihiko Takagi, Tama, Japan

[73] Assignee: Tokyo Shibaura Denki Kabushiki Kaisha, Kanagawa, Japan

[21] Appl. No.: 423,292

[22] Filed: Sep. 24, 1982

[30] Foreign Application Priority Data

Oct. 15, 1981 [JP] Japan ..... 56-163430

[51] Int. Cl.[3] ..... H01B 17/50; H01H 33/66

[52] U.S. Cl. ..... 174/30; 174/209; 174/211; 174/212; 200/144 B

[58] Field of Search ..... 174/30, 178, 209, 210, 174/211, 212; 200/144 B

[56] References Cited

U.S. PATENT DOCUMENTS 3,795,646 3/1974 MacKenzie, Jr. et al. ... 260/29.1 SB

FOREIGN PATENT DOCUMENTS 1814498 6/1970 Fed. Rep. of Germany ..... 174/209
1928006 5/1971 Fed. Rep. of Germany ..... 174/30
119493 4/1976 Fed. Rep. of Germany ..... 174/211
740938 11/1955 United Kingdom ..... 174/211
1191664 5/1970 United Kingdom ..... 200/144 B
2029643 3/1980 United Kingdom ..... 174/209

*Primary Examiner*—Laramie E. Askin
*Attorney, Agent, or Firm*—Stevens, Davis, Miller & Mosher

[57] ABSTRACT

An electrical insulator for use in dirty or wet environments. The insulator has a substantially cylindrical outer peripheral surface upon which is disposed a plurality of water-repellent oil-bleeding insulation bonds formed of a silicone rubber containing a water-repellent silicone oil. The bands are fitted onto the insulator surface so that they extend perpendicular, parallel or oblique to the longitudinal axis of the insulator. The bands each may be in the form of a hollow belt with a clamp band passing through the interior thereof for clamping the belt to the outer peripheral surface of the insulator.

7 Claims, 10 Drawing Figures

ELECTRICAL INSULATOR WITH WATER-REPELLENT OIL-BLEEDING INSULATION BANDS

BACKGROUND OF THE INVENTION

This invention relates to insulators, and more particularly, to cylindrical insulators, such as insulating members of vacuum circuit-breakers, insulation operating rods, or the like which are disposed in dirty or wet environments, each insulator comprising insulation belts or bands to increase insulation capacity and creeping distance.

Recently, design emphasis has been on compact electric installations which are designed within the limitations of conventional insulation techniques. Vacuum circuit-breakers are typical examples. They have been largely reduced in shape and have been widely used in a piled arrangement in multi-stages in a switchboard. In many instances they are used in adverse circumstances under dirty or wet conditions.

Generally, an insulating vessel of a vacuum circuit-breaker, i.e., a vacuum switch, is required to possess a high insulation ability and a high gas-tight characteristic in addition to being compact. For these requirements, the vacuum switch is generally made of glass or ceramics and has a cylindrical configuration. However, since the insulating vessel of such a vacuum switch has a creeping surface insulation distance less than that of a conventional corrugated insulator, voltage stress on the creeping surface will become high and the insulation characteristics will be degraded in a case where the vacuum switch is disposed in contaminated or wet environments. Particularly, during a breaking time of a capacitor circuit, an interelectrode voltage is duplicated, so that a flashover phenomenon may easily occur on the surface of the insulating vessel of the vacuum circuit-breaker causing it to fail in its circuit-breaking function.

At a time of inspection or maintenance of a vacuum switch which is contained in a casing such as that disposed on a pole, the voltage at the outside of the casing is inspected by a voltage detector to confirm the condition of contact opening of the switch, and in this case, when an insulation condition on the outer surface of the insulating vessel is degraded by dirt, dust, or moisture, the detector may erroneously detect the voltage even if the contact of the switch is normally open. In addition, with insulators made of organic materials such as insulation operating rods of switching mechanisms, a tracking phenomenon, which finally results in insulation breakdown in an adverse case, may be developed by creeping discharge when the outer surfaces of the insulators are under dirty or wet conditions.

From further point of view, recently there has been provided a vacuum switch which has an outer surface coated with an insulating film such as a resin film, the thus coated resin may easily be dried and the water repellent characteristic of the resin will be degraded as time elapses because of adhered dust or the like.

SUMMARY OF THE INVENTION

It is an object of this invention to provide improved insulators capable of obviating defects encountered in the prior art and attaining a high insulation capacity even if disposed in dirty or wet environments.

Another object of this invention is to provide an improved insulator provided with an insulation band for increasing insulation capacity and creeping distance on the outer surface of the insulator.

According to this invention, there is provided insulators having a cylindrical configuration, each comprising a plurality of insulation bands each provided with a water repellent oil-bleed characteristic and disposed on the outer surface of the cylindrical insulator.

DESCRIPTION OF THE PREFERRED EMBODIMENTS

For better understanding of the present invention, a prior art vacuum switch shown in FIG. 1 will first be described, which comprises an outer cylindrical insulating vessel 1, a pair of separable contacts 2 and 3, and metal flanges 5 sealing the vessel 1. The construction of the vacuum switch of this type has been space compacted, and accordingly the outer creeping surface of the insulating vessel 1 has decreased. For this reason, it has been required for the vacuum vessel to have high insulation ability and gas-tight characteristic to prevent a lowering of the insulation strength of the outer surface of the vacuum vessel 1.

Figure 1:
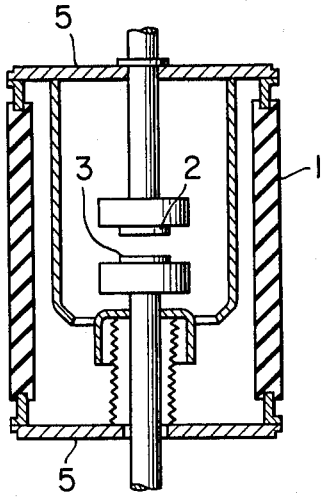
FIG. 1 PRIOR ART
FIG. 1 shows an elevational section of a conventional vacuum switch.
Figure 2:
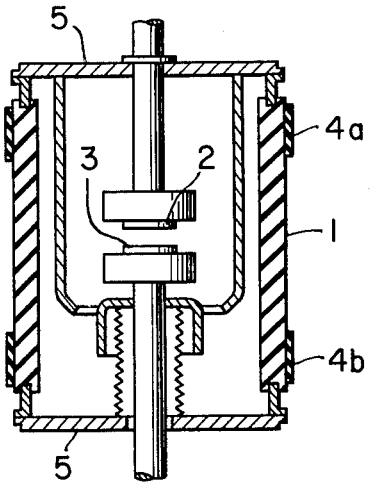
FIG. 2 shows an elevational section of a vacuum switch to which insulation bands are applied according to this invention.

FIG. 2 shows one embodiment of this invention applied to a conventional vacuum switch shown in FIG. 1 for obviating defects encountered in the prior type device. According to this invention, a plurality of expandable insulation rubber bands (two, in this embodiment) 4*a* and 4*b* are secured onto the outer peripheral surface of the insulating vessel 1. The insulation rubber band according to this invention is different from a usual rubber and uses a porous rubber, preferably, a silicone rubber in which silicone oil is impregnated between molecules of the silicone rubber layer to thereby impart a water repellent and oil-bleeding characteristic to the silicone rubber. To this end the surface of the silicone rubber layer is coated with a thin layer of silicone oil to cause it to impregnate the silicone rubber layer which is then subjected to heat vulcanization. Since the silicone rubber and the silicone oil do not directly react, a matrix other than silicone may be used. The viscosity of the silicone oil affects the matrix used and the spreading speed thereof on the surface of an insulator such as a vacuum switch vessel. The silicone oil having a relatively small viscosity can easily be impregnated into the matrix and promptly spreads on the surface of the insulator, but has a relatively short effective life and substantially reverse effects are obtained where a silicone oil having a relatively higher viscosity is used. In our experiments, it was found that the silicone oil having a viscosity of about several thousands to several tens of thousands cst (centistokes) is adequate for the present invention.

One or more insulation rubber bands thus prepared can be fitted around the outer peripheral surface of the vacuum vessel in a direction substantially normal to the axial direction thereof.

According to the insulation, in the rubber bands applied to the vacuum switch, the silicone oil having a strong water repellent characteristic is stored in the silicone rubber bands so that the silicone oil constantly bleeds onto the outer surfaces of the insulation rubber bands 4*a* and 4*b* and the interfaces between the bands and the insulating vessel 1, whereby the lowering of the insulation strength of the surface of the insulator can effectively be prevented by the strong oil-bleeding characteristic of the silicone oil even if the surface thereof is contaminated or wetted.

Glass or ceramic is generally used for a material of the insulating vessel 1 and when these materials are contaminated or wetted, an electroconductive thin film of dirt or wet material readily spreads over the glass or ceramic surface of the vacuum vessel, which results in the lowering of the insulation strength. Since the insulation rubber bands 4*a* and 4*b* of this invention are fitted around the outer peripheral surface of the cylindrical insulator, the lowering of the insulation strength at these portions can be effectively prevented. When contaminated or wetted, most of the voltage impressed across the surface of the insulator concentrates at portions where the rubber bands are fitted, so that it is possible to apply a plurality of these rubber bands therearound in accordance with ambient condition or service voltage to thereby alleviate the voltage concentration and prevent the lowering of the insulation ability.

Figure 3:
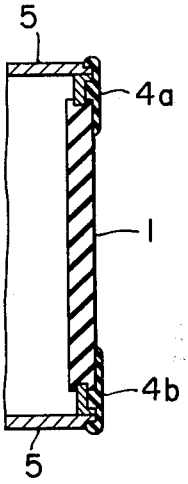
FIG. 3 shows a partial sectional view of one modification of the embodiment shown in FIG. 2.

FIG. 3 shows one modification of the present invention applied to a vacuum switch, in which the insulation rubber bands 4*a* and 4*b* are fitted onto portions connecting the insulating vessel 1 and metal flanges 5 sealing the vessel 1 of the vacuum switch, whereby portions of the creeping surfaces of the flanges 5 are effectively utilized as insulating creeping distance.

Figure 4:
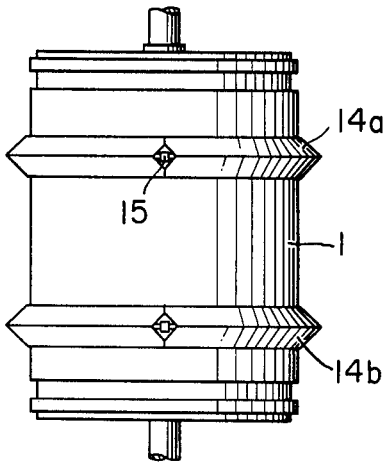
FIG. 4 shows a schematic view of a vacuum switch provided with modified insulation bands.
Figure 5:
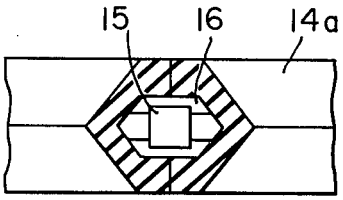
FIG. 5 shows an enlarged view of a portion of the insulation rubber belt shown in FIG. 4.
Figure 6:
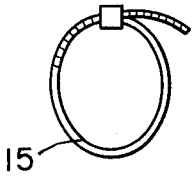
FIG. 6 shows a clamp band for clamping the belt shown in FIG. 4.

FIGS. 4 through 6 show another embodiment of this invention, in which hollow rubber belts 14*a* and 14*b*, triangular in cross-section, are wound around the cylindrical outer surface of the vacuum vessel 1 and tightly fitted thereon by using clamp bands 15. The hollow rubber belts 14*a* and 14*b* are also made of silicone rubber to which water repellent oil-bleeding characteristic is imparted by the method described above, and one or more belts can be fitted around the outer peripheral surface of the insulating vessel 1 of the vacuum switch to extend in a direction substantially normal to the axial direction thereof. With this embodiment, the rubber belts 14*a* and 14*b* are fitted by the steps of cutting the hollow rubber belt so as to have a length slightly longer than the peripheral length of the insulating vessel 1 on which the belt is wound, obliquely cutting both ends of the cut belt, connecting the ends to form a central hole as shown in FIG. 5 which is an enlarged view, and clamping the belt by the clamp band 15 made of, for example, plastic. According to this construction, the silicone oil having a strong water repellent characteristic is stored in the hollow rubber belts and the oil always bleeds out onto the surfaces of the belts and the surface of the insulating vessel near the belts, so that the contact surface of the belt to the insulating vessel is always maintained at a high resistance.

The hollow insulating rubber belt according to this invention can be applied to cylindrical insulators having various shapes or sizes. When fitting the belts, since the belts are fitted by winding them around the insulator without disassembling members connected to the insulator, the belts can readily be fitted in the field. In addition, the hollow insulation rubber belts are mechanically clamped on the insulating vessel by the clamp band shown in FIG. 6, so that the belts can be applied to insulators of circuit-breakers, for example, to which considerably strong striking force is applied.

In the foregoing discussion, although a hollow rubber belt having triangular cross-section is described as being used for increasing contacting area and creeping distance, the present invention is not limited thereto and a plate-like belt can be used in place of the hollow belt, in which case the plate belt is clamped by a clamp band thereon.

Figure 7A:
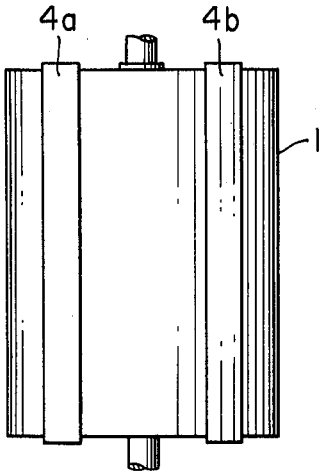
FIG. 7A shows a schematic view of a vacuum switch provided with another modified form of insulation bands.
Figure 7B:
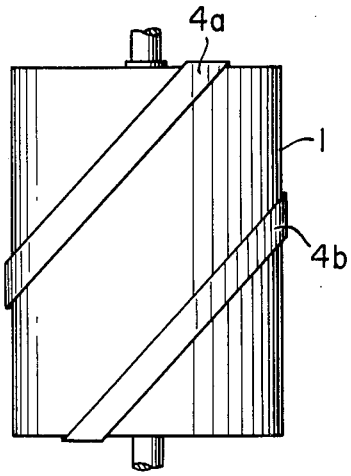
FIG. 7B shows a schematic view of a vacuum switch provided with another modified form of insulation bands.
Figure 8A:
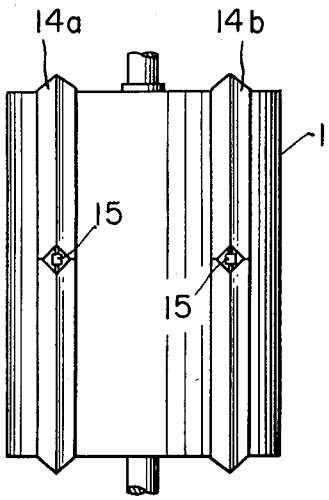
FIG. 8A shows a schematic view of a vacuum switch provided with another modified form of insulation bands.
Figure 8B:
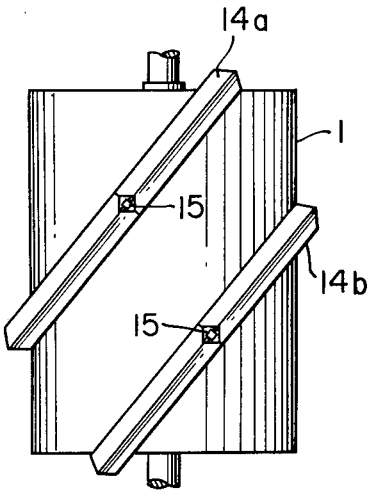
FIG. 8B shows a schematic view of a vacuum switch provided with another modified form of insulation bands.

FIGS. 7A and 7B and FIGS. 8A and 8B schematically show further modifications according to this invention. In FIGS. 7A and 7B, respective insulation rubber bands 4*a* and 4*b* are vertically and obliquely fitted around the outer surfaces of the cylindrical vacuum vessel and in FIGS. 8A and 8B, the hollow insulation rubber belts 14*a* and 14*b* are respectively fitted vertically and obliquely onto the outer surfaces of the cylindrical vacuum vessels 1. With these embodiments, substantially the same effects as those attained in the embodiments shown in FIGS. 2 and 4 can be also obtained.

It should be noted that the present invention is not limited to the embodiments or modifications described hereinabove such as the shapes thereon and that it can also be applied to any cylindrical organic insulator to prevent tracking caused by creeping discharge. In addition, regarding an element or device, for example, an arrester, in which inner elements, such as gap elements, a nonlinear resistor, or the like, are contained in an insulating vessel, although discharge characteristics is often remarkably lowered by the disturbance of an electric field stress on the outer surface due to the dirty or wet condition, the electric field can be uniformly stabilized to thereby prevent the lowering of the discharge characteristics by applying a plurality of insulation rubber bands according to this invention to extend in a direction substantially normal to the axial direction of the arrester.

According to this invention, as described hereinabove, it is not necessary to manufacture or use insulators having complicated shapes such as corrugated insulators to increase the creeping distance, and insulators having straight outer shapes can easily be manufactured without lowering insulation capacity. In addition, the creeping distance and the insulation capacity can be easily increased by properly using a plurality of insulation rubber bands according to the dirty or wet conditions under which the insulators are installed. More-over, problems of tracking, etc., inherent to an insulator made of an organic insulating material can be avoided.

I claim:

1. An electrical insulator having a substantially cylindrical outer peripheral surface and having a plurality of water-repellant oil-bleeding insulation bands disposed on said outer surface.

2. The electrical insulator according to claim 1 wherein said insulation bands comprise an expandable rubber.

3. The electrical insulator according to claim 2 wherein said expandable rubber comprises a silicone rubber containing a water-repellent silicone oil.

4. The electrical insulator according to claim 1 wherein each of said insulation bands comprises a hollow rubber belt and a clamp band passing through the inner hollow portion of said hollow rubber belt to clamp the belt on said outer peripheral surface.

5. The electrical insulator according to claim 1 or 4 wherein said insulation bands are fitted onto said outer surface in a direction substantially normal to a longitudinal axial direction of said insulator.

6. The electrical insulator according to claim 1 or 4 wherein said insulation bands are fitted onto said outer surface to extend in a direction substantially parallel with the longitudinal axial direction of said insulator.

7. The electrical insulator according to claim 1 or 4 wherein said insulation bands are obliquely fitted onto said outer surface.

* * * * *